US009505101B1

(12) United States Patent
Register

(10) Patent No.: US 9,505,101 B1
(45) Date of Patent: Nov. 29, 2016

(54) AUTOMATED SANDING SYSTEM AND METHOD

(71) Applicant: THE BOEING COMPANY, Chicago, IL (US)

(72) Inventor: Justin H. Register, Charleston, SC (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 14/748,356

(22) Filed: Jun. 24, 2015

(51) Int. Cl.

| | |
|---|---|
| ***B24B 49/03*** | (2006.01) |
| ***B24B 49/04*** | (2006.01) |
| ***B24B 49/05*** | (2006.01) |
| ***B24B 23/08*** | (2006.01) |
| ***B24B 55/10*** | (2006.01) |

(52) U.S. Cl.
CPC ..... *B24B 49/04* (2013.01); *B24B 23/08* (2013.01); *B24B 49/045* (2013.01); *B24B 55/10* (2013.01)

(58) Field of Classification Search
CPC ..... B24B 9/002; B24B 23/08; B24B 55/04; B24B 55/06; B24B 49/00; B24B 49/02; B24B 49/03; B24B 49/04; B24B 49/045; B24B 49/05; B24B 49/06
USPC ..... 451/9, 10, 11, 54, 336
See application file for complete search history.

(56) References Cited

U.S. PATENT DOCUMENTS

| | | | | |
|---|---|---|---|---|
| 3,494,041 | A * | 2/1970 | Freeman | G01B 3/22 33/556 |
| 6,168,499 | B1 * | 1/2001 | Jang | B24B 7/228 134/104.1 |
| 7,350,890 | B2 | 4/2008 | Baird | |
| 8,088,450 | B2 | 1/2012 | Swanberg | |
| 8,347,746 | B2 | 1/2013 | Hafenrichter | |
| 8,455,054 | B2 | 6/2013 | Brewer | |
| 8,912,790 | B2 * | 12/2014 | Lu | G01B 7/10 324/207.13 |
| 9,138,855 | B2 * | 9/2015 | Kang | B24B 27/0076 |
| 2008/0070480 | A1 * | 3/2008 | Nomiya | B24B 37/013 451/22 |
| 2009/0067940 | A1 * | 3/2009 | Arai | B24B 9/14 408/22 |
| 2013/0265588 | A1 | 10/2013 | Cooke | |
| 2015/0221562 | A1 * | 8/2015 | Torikoshi | H01L 22/12 438/692 |

* cited by examiner

*Primary Examiner* — Eileen Morgan
(74) *Attorney, Agent, or Firm* — Joseph M. Butscher; The Small Patent Law Group, LLC

(57) ABSTRACT

A sanding system may include a leading roller assembly having a first measuring device that is configured to measure a first thickness of a component at a location proximate the leading roller assembly. A trailing roller assembly may include a second measuring device that is configured to measure a second thickness of the component at a location proximate the trailing roller assembly. A sander disposed between the leading and trailing roller assemblies is configured to sand a portion of the component. A control unit is coupled to the leading roller assembly, the trailing roller assembly, and the sander. The control unit may be configured to drive the sanding system in relation to the component and operate the sander based on analysis of the first thickness measured by the first measuring device and the second thickness measured by the second measuring device.

20 Claims, 7 Drawing Sheets

AUTOMATED SANDING SYSTEM AND METHOD

FIELD OF THE DISCLOSURE

Embodiments of the present disclosure generally relate to automated sanding systems and methods.

BACKGROUND OF THE DISCLOSURE

Various types of aircraft include a fuselage that defines an internal cabin. The fuselage may be formed as a circumferential shape, such as cylindrical or barrel-shaped. The fuselage, as well as various other portions of the aircraft, may be formed of composite materials. For example, the fuselage may be formed of multiple composite barrel sections. A trailing end of one barrel section connects to a leading end of another barrel section.

Interfacing ends of the barrel sections typically are sanded in order to be within a particular specified thickness. In general, the end segments are manually sanded. That is, an individual uses one or more sanding devices to precisely abrade or otherwise remove portions of the barrel segments to a specified thickness.

As each barrel section may be formed of composite materials, a curing process may be used to form each barrel section. For example, each barrel section may be cured within an autoclave. In order to ensure that the barrel sections retain a desired shape during the curing process, various structural supports (such as braces, ribs, beams, or the like) may be secured to portions of the barrel sections within an autoclave. In order to minimize or reduce a possibility that the supports mar, den, mark, or otherwise damage portions of a barrel section during a curing process, patches (such as shims) may be positioned between the supports and portions of the barrel section. After the curing process, the structural supports are removed, and the patches are removed through sanding.

As noted, the sanding process is performed manually, and is time and labor intensive. For example, an individual manually sands the patches, and then measures the thickness of a sanded area to ensure that is at or within a specified thickness. Sometimes, however, the individual may over-sand a portion of a barrel section. As such, the thickness may be too thin to safely and securely connect to another barrel section. Therefore, the over-sanded barrel section may need to be re-worked or discarded.

Accordingly, a need exists for a system and method of accurately and efficiently sanding components, such as ends of composite barrel sections of a fuselage of an aircraft.

SUMMARY OF THE DISCLOSURE

Certain embodiments of the present disclosure provide a sanding system configured to sand a portion of component. The sanding system may include a leading roller assembly having a first measuring device that is configured to measure a first thickness of the component at a location proximate the leading roller assembly. A trailing roller assembly may include a second measuring device that is configured to measure a second thickness of the component at a location proximate the trailing roller assembly. A sander disposed between the leading roller assembly and the trailing roller assembly is configured to sand the portion of the component. A control unit may be coupled to the leading roller assembly, the trailing roller assembly, and the sander. The control unit may include at least one processor, and a memory coupled to the at least one processor. The memory may store program instructions that are executable by the processor(s) to drive the sanding system in relation to the component and operate the sander based on analysis of the first thickness measured by the first measuring device and the second thickness measured by the second measuring device.

The sanding system may also include at least one motor operatively coupled to the control unit and one or both of the leading roller assembly and the trailing roller assembly. The motor(s) may be configured to drive the sanding system over the portion of the component.

The sanding system may also include a tension roller assembly having at least one roller that is configured to engage a surface of the component. The tension roller assembly may be configured to bias the sander into the component.

An actuator may be operatively connected to the sander. The control unit may be coupled to the sander through the actuator.

In at least one embodiment, the leading roller assembly includes a first roller and a second roller. The leading location of the component may be positioned between the first and second rollers. Similarly, in at least one embodiment, the trailing roller assembly may include a third roller and a fourth roller. The trailing location of the component may be positioned between the third and fourth rollers.

In at least one embodiment, the first roller may connect to the second roller through a first connecting shaft, and the third roller may connect to the fourth roller through a second connecting shaft. The first measuring device may be secured to the first roller, the second roller, and/or the first connecting shaft. The second measuring device may be secured to the third roller, the fourth roller, and/or the second connecting shaft. The first connecting shaft may include a first biasing spring that biases the first and second rollers toward one another. The second connecting shaft may include a second biasing spring that biases the third and fourth rollers toward one another.

The sanding system may also include a mounting cover that surrounds a perimeter of the sander, and a housing mounted on the mounting cover. In at least one embodiment, the housing contains the control unit. The mounting cover may include a vacuum port that is configured to connect to a vacuum that is configured to remove debris generated by operation of the sander through the vacuum port.

In at least one embodiment, the control unit is remotely located from and in communication with leading roller assembly, the trailing roller assembly, the motor, and the sander. For example, the control unit may be part of a handheld remote control device that is connected to the sanding system through a wired or wireless connection.

In at least one embodiment, the control unit is configured to monitor the first thickness to determine an amount of material to be sanded from the component. The control unit may also be configured to monitor the second thickness to determine if a sanded portion of the component is within a specified thickness. The control unit may continuously monitor the first and second thicknesses during operation of the sanding system.

At least one of the first and second measuring devices may include a rotational position sensor that may include at least one wheel. The control unit may be configured to monitor rotational positions of the wheel(s).

The sanding system may also include a support base connected to the sander. A position of the support base in relation to the component may be adjustable. For example, the position of the support base may be manually or automatically adjusted.

Certain embodiments of the present disclosure provide a method of sanding a portion of component. The method may include driving a sanding system over the portion of the component, using a first measuring device of a leading roller assembly of the sanding system to measure a first thickness of the component at a location proximate the leading roller assembly, using a second measuring device of a trailing roller assembly of the sanding system to measure a second thickness of the component at a location proximate the trailing roller assembly, analyzing the first thickness measured by the first measuring device and the second thickness measured by the second measuring device, and operating a sander between the leading and trailing roller assemblies based on the analyzing.

The method may also include removing debris caused by the operating through a vacuum port. The analyzing may include monitoring the first thickness to determine an amount of material to be sanded from the component, and monitoring the second thickness to determine if a sanded portion of the component is at or within a specified thickness. The method may also include adjusting a position of the sander in relation to the component based on the analyzing.

DETAILED DESCRIPTION OF THE DISCLOSURE

The foregoing summary, as well as the following detailed description of certain embodiments will be better understood when read in conjunction with the appended drawings. As used herein, an element or step recited in the singular and preceded by the word "a" or "an" should be understood as not necessarily excluding the plural of the elements or steps. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Embodiments of the present disclosure provide automated sanding systems and methods. The sanding systems and methods reduce the amount of labor and time to form various components, such as barrel sections that are used to form a fuselage of an aircraft. In at least one embodiment, an automated, robotic sanding system may be clamped to a component (such as an end of a barrel section) and crawl on, over, and/or around the component to efficiently and accurately sand a portion of the component to a desired thickness, thereby eliminating, minimizing, or otherwise reducing the need for re-working the component. As such, embodiments of the present disclosure provide substantial time and cost savings. For example, embodiments of the present disclosure substantially reduce the time and labor used to sand and join portions of barrel segments of a fuselage of an aircraft.

Certain embodiments of the present disclosure provide a robotic sanding system that may include an actuator (such as an electric motor), a first plurality of wheels that are configured to provide a desired clamping force to a component, a second plurality of wheels configured to engage an outer surface of the component so that a varying amount of material of the component may be removed as desired, and a sanding mechanism. The sanding mechanism may include a plurality of springs, an abrasive, and a height adjuster. The springs may be configured to ensure that the abrasive maintains a desired pressure against a surface of the component.

Figure 1:
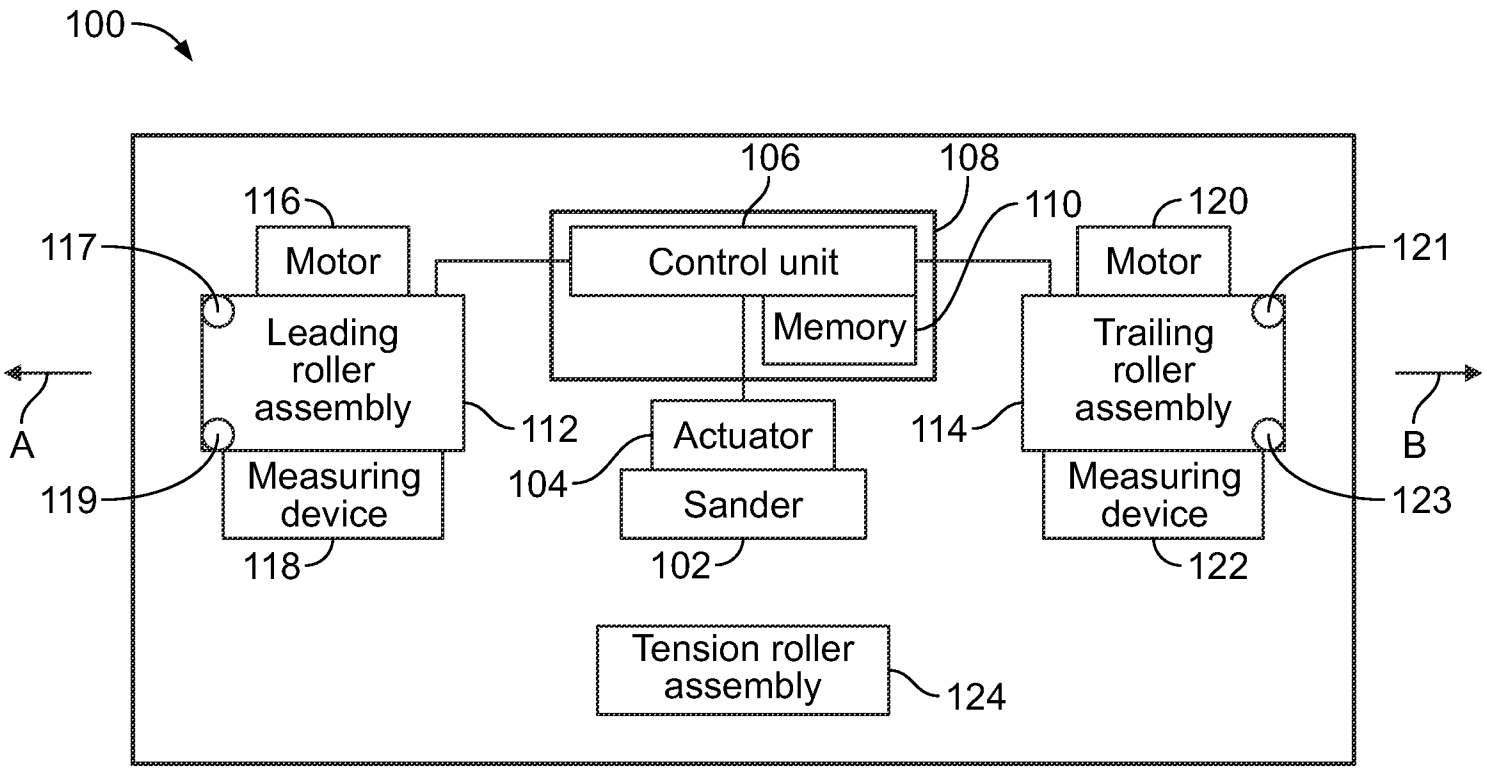
FIG. 1 illustrates a schematic block diagram of a sanding system, according to an embodiment of the present disclosure.

FIG. 1 illustrates a schematic block diagram of a sanding system 100, according to an embodiment of the present disclosure. The sanding system 100 may be used to automatically sand a portion of a component (such as an end portion of a barrel section of a fuselage) to a specified thickness. The sanding system 100 may include a sander 102 operatively coupled to an actuator 104. The actuator 104 may be operatively coupled to a control unit 106 contained within a housing 108, such as through a wired or wireless connection. The control unit 106 may be coupled to a memory 110, which may store instructions for operation of the sanding system 100. The control unit 106 may include the memory 110.

The sander 102 may be various types of sanders, such as a vibrational sander, an orbital sander, a reciprocating sander, or the like. The actuator 104 may be of various types that are configured to actuate the sander to sand the component. For example, the actuator 104 may be an electric, pneumatic, hydraulic, piezoelectric, or other such motor or actuating device.

The control unit 106 may also be coupled to a leading roller assembly 112 and a trailing roller assembly 114, such as through one or more wired or wireless connections, wherein the sander 102 is disposed between the leading roller assembly 112 and the trailing roller assembly 114. The leading roller assembly 112 may include a motor 116 (such as an electric motor) that is configured to drive one or more rollers of the leading roller assembly 112. Optionally, the motor 116 may be remotely located from the leading roller assembly 112. A measuring device 118 may be used to measure a thickness of a component as the leading roller assembly 112 travels over the component. The measuring device 118 may include one or more of a micrometer, calipers, electromagnetic or RFID position sensor(s), and/or the like.

The leading roller assembly 112 may include an interior roller 117 and an exterior roller 119 that are configured to sandwich a portion of the component therebetween. Each roller 117 and 119 may include or be connected to the measuring device 118, such as a position sensor that is in communication with the control unit 106, such as through a wired or wireless connection. The control unit 106 analyzes the position of the rollers 117 and 119 (through signal(s) received from the measuring device 118) to determine a distance therebetween, and may correlate the distance between the rollers 117 and 119 to a thickness of the component. As such, the control unit 106 may determine a thickness of the component by monitoring signals received from the measuring device 118. Alternatively, the leading roller assembly 112 may include more or less rollers than shown.

Similarly, the trailing roller assembly 114 may include a motor 120 (such as an electric motor) that is configured to drive one or more rollers, such as an interior roller 121 and an exterior roller 123. Optionally, the motor 120 may be remotely located from the trailing roller assembly 114. Each roller 117 and 119 may include or be connected to a measuring device 122, such as a position sensor that is in communication with the control unit 106, such as through a wired or wireless connection. The measuring device 122 may be used to measure a thickness of a component as the trailing roller assembly 114 travels over the component. The measuring device 122 may include one or more of a micrometer, calipers, electromagnetic or RFID position sensors, or the like. Alternatively, the trailing roller assembly 114 may include more or less rollers than shown.

The control unit 106 analyzes the position of the rollers 121 and 123 to determine a distance therebetween (such as through signal(s) received from the measuring device 122), and may correlate the distance between the rollers 121 and 123 to a thickness of the component. As such, the control unit 106 may determine a thickness of the component by monitoring signals received from the measuring device 122.

Optionally, only one of the leading and trailing roller assemblies 112 and 114 may include a motor configured to drive at least one roller. For example, the leading roller assembly 112 may include the motor 116, while the trailing roller assembly 114 is devoid of a motor. In at least one other embodiment, neither the leading nor trailing roller assemblies 112 and 114 may include a motor. Instead, a motor may be used to drive one or more rollers of a tension roller assembly 124, which may be used to engage a first surface (such as an exterior surface) of a component and bias the sander 102 into an opposite second surface (such as an interior surface) of the component. Optionally, the sanding system 100 may not include the tension roller assembly 124.

As shown, the control unit 106 and the memory 110 may be contained within the housing 108 of the sanding system 100. Alternatively, the control unit 106 and the memory 110 may be remotely located from the housing 108. For example, the control unit 106 and the memory 110 may be part of a computer that is in communication with the sanding system 100 through one or more wired or wireless connections. In at least one other embodiment, the control unit 106 and the memory 110 may be contained within a handheld remote control device that is coupled to the sanding system 100.

In operation, the control unit 106 drives the sanding system 100 over a component. For example, inner and outer rollers of each of the roller assemblies 112 and 114 may be positioned on opposite surfaces of the component, while the sander 102 that is disposed between the leading roller assembly 112 and the trailing roller assembly 114 is biased into a surface to be sanded (and the tension roller assembly 124 abuts into an opposite surface). The control unit 106 causes one or more of the motors 116 and 120 to drive one or more rollers of the assemblies 112 and 114 and therefore move the sanding system 100 in a desired direction in relation to the component.

As the sanding system 100 is driven over the component, the control unit 106 monitors the thickness of the component at leading and trailing locations proximate to the leading and trailing roller assemblies 112 and 114, respectively. For example, the leading location may be the portion of the component that is proximate to or between the rollers 117 and 119, while the trailing location may be the portion of the component that is proximate to or between the rollers 121 and 123, where proximate to may be within an inch, for example, of the portion of the component that is proximate to or between the rollers. The leading roller assembly 112 "leads" in that it travels over a portion of the component in an advancing direction before the sander 102 operates to sand the portion of the component. The trailing roller assembly 114 "trails" in that it travels over the portion of the component in the advancing direction after the sander 102 operates to sand the portion of the component. By monitoring the thickness of the component at the leading location proximate to or between the leading rollers 117 and 119 and the trailing location proximate to or between the trailing rollers 121 and 123, such as through receiving distance or positional signals from the measuring devices 118 and 122, the control unit 106 is able to determine the amount of material to be sanded from the component (by monitoring the measuring device 118), and also to determine if the sanded portion of the component is within a specified thickness (by monitoring the measuring device 122). The control unit 106 may access data related to the specified thickness, which may be stored in the memory 110, or within a memory of a remote system (such as a computer) in communication with the control unit 106.

If the thickness of the sanded portion of the component is at or within the specified thickness (or within an acceptable range of the specified thickness), the control unit 106 continues to operate the sanding system 100 to move over the component in the advancing direction A. If, however, the thickness of the sanded portion is thicker than the specified thickness, the control unit 106 may stop the sanding system 100, and then move the sanding system 100 in a reversing direction B so that the portion of the component may be further sanded. Optionally, instead of stopping and reversing the sanding system 100, the control unit 106 may continue to move the sanding system 100 in the advancing direction A, which may eventually bring the sanding system 100 back to the portion of the component that needs additional sanding (such as if the component is a cylindrical barrel section).

The control unit 106 may include one or more processors configured to perform the functions described in the present application. For example, in at least one embodiment, the control unit 106 may be or include one or more processors and memory configured to perform the respective operations described herein. In at least one other embodiment, a single processor or multiple processors may be configured to perform the operations described in the present application.

The control unit 106 and the memory 110 may be contained within the housing 108 or a remote housing that may be or otherwise include one or more computing devices, such as standard computer hardware (for example, processors, circuitry, memory, and the like). The control unit 106 may include one or more circuits, or the like, such as processing devices that may include one or more microprocessors, microcontrollers, integrated circuits, memory, such as read-only and/or random access memory, and the like. As an example, the control unit 106 may include or be formed as an integrated chip. One or more of the components may be separate and distinct circuits or processors within the system 100, for example.

As used herein, the term "controller," "control unit," "unit," "central processing unit," "CPU," "computer," or the like may include any processor-based or microprocessor-based system including systems using microcontrollers, reduced instruction set computers (RISC), application specific integrated circuits (ASICs), logic circuits, and any other circuit or processor capable of executing the functions described herein. Such are exemplary only, and are thus not intended to limit in any way the definition and/or meaning of such terms.

The control unit 106 is configured to execute a set of instructions that are stored in one or more storage elements (such as one or more memories), in order to process data. For example, the control unit 106 may include or be coupled to one or more memories. The storage elements may also store data or other information as desired or needed. The storage element may be in the form of an information source or a physical memory element within a processing machine.

The set of instructions may include various commands that instruct the control unit 106 as a processing machine to perform specific operations such as the methods and processes of the various embodiments of the subject matter described herein. The set of instructions may be in the form of a software program. The software may be in various forms such as system software or application software. Further, the software may be in the form of a collection of separate programs or modules, a program module within a larger program or a portion of a program module. The software may also include modular programming in the form of object-oriented programming. The processing of input data by the processing machine may be in response to user commands, or in response to results of previous processing, or in response to a request made by another processing machine.

It is to be understood that the processing or control units may represent circuit modules that may be implemented as hardware with associated instructions (e.g., software stored on a tangible and non-transitory computer readable storage medium, such as a computer hard drive, ROM, RAM, or the like) that perform the operations described herein. The hardware may include state machine circuitry hardwired to perform the functions described herein. Optionally, the hardware may include electronic circuits that include and/or are connected to one or more logic-based devices, such as microprocessors, processors, controllers, or the like. Optionally, the control units may represent processing circuitry such as one or more of a field programmable gate array (FPGA), application specific integrated circuit (ASIC), microprocessor(s), a quantum computing device, and/or the like. The circuits in various embodiments may be configured to execute one or more algorithms to perform functions described herein. The one or more algorithms may include aspects of embodiments disclosed herein, whether or not expressly identified in a flowchart or a method.

As used herein, the terms "software" and "firmware" are interchangeable, and include any computer program stored in memory for execution by a computer, including RAM memory, ROM memory, EPROM memory, EEPROM memory, and non-volatile RAM (NVRAM) memory. The above memory types are exemplary only, and are thus not limiting as to the types of memory usable for storage of a computer program.

Figure 2:
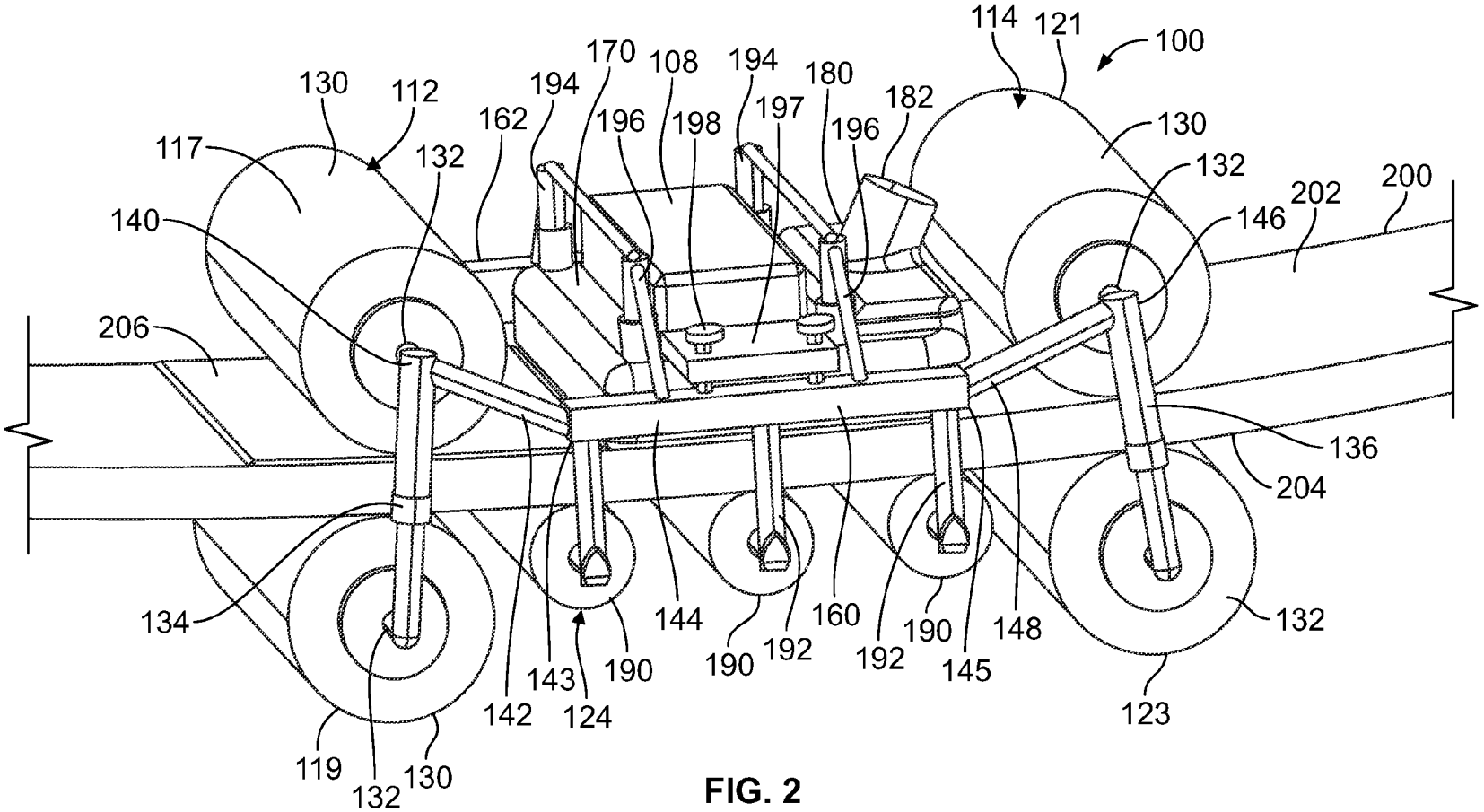
FIG. 2 illustrates a front top perspective view of a sanding system positioned on a portion of a component, according to an embodiment of the present disclosure.

FIG. 2 illustrates a front top perspective view of the sanding system 100 positioned on a portion of a component 200, according to an embodiment of the present disclosure. The component 200 may be an arcuate barrel section that is to be connected to another barrel section to form a portion of a fuselage of an aircraft. The portion of the component 200 may be an end edge of the barrel section. The component 200 includes a first surface 202, such as an interior surface, and a second surface 204, such as an exterior surface. As shown, the component 200 may be arcuate. Alternatively, the component 200 may be flat or otherwise linear.

A patch 206, such as a pre-cured strip, may be secured onto the first surface 202. The patch 206 may be used to protect the component from being damaged by a structural support during a curing process. Accordingly, after the curing process, the patch 206 is configured to be removed through sanding. The sanding system 100 is configured to automatically sand the patch 206 and the first surface 202 to a specified thickness. For example, the sanding system 100 may be configured to completely remove the patch 206 through sanding.

Referring to FIGS. 1 and 2, the leading roller assembly 112 may include the first or interior roller 117 and the second or exterior roller 119. Each roller 117 and 119 may include a cylindrical wheel 130 having an axle 132. A distal end of each axle 132 may connect to an end of a connecting shaft 134 that connects the rollers 117 and 119 together. Only one connecting shaft 134 may be used to connect the rollers 117 and 119 together, so as to allow the sanding system 100 to be easily mounted onto the component 200 from an end. Alternatively, an additional connecting shaft may be positioned on the other ends of the rollers 117 and 119.

The connecting shaft 134 connects the rollers 117 and 119 together and also exerts an inwardly-directed biasing force that causes the rollers 117 and 119 to clamp or otherwise bias towards one another. As the sanding system 100 is driven over the component 200, the rollers 117 and 119 remain in contact with the component 200, and may move relative to one another as the thickness of the component 200 changes at various locations.

The motor 116 may be operatively connected to one or both wheels 130 of the rollers 117 and 119. For example, the motor 116 may be operatively connected to an end of the connecting shaft 134 and to one or both of the axles 132 of the rollers 117 and 119.

The trailing roller assembly 114 may include the first or interior roller 121 and the second or exterior roller 123. Each roller 121 and 123 may include a cylindrical wheel 130 having an axle 132. A distal end of each axle 132 may connect to an end of a connecting shaft 136 that connects the rollers 121 and 123 together. Only one connecting shaft 136 may be used to connect the rollers 121 and 123 together, so as to allow the sanding system 100 to be easily mounted onto the component 200 from an end. Alternatively, an additional connecting shaft may be positioned on the other sides of the rollers 121 and 123.

The connecting shaft 136 connects the rollers 121 and 123 together and also exerts an inwardly-directed biasing force that causes the rollers 121 and 123 to clamp or otherwise bias towards one another. As the sanding system 100 is driven over the component 200, the rollers 121 and 123 remain in contact with the component 200, and may move relative to one another as the thickness of the component 200 changes at various locations.

The motor 120 may be operatively connected to one or both wheels 130 of the rollers 121 and 123. For example, the motor 116 may be operatively connected to an end of the connecting shaft 136 and connected to one or both of the axles 132 of the rollers 121 and 123.

An interior end 140 of the connecting shaft 134 may connect to an extension beam 142 that connects to a leading end 143 of a support base 144 of the sanding system 100. Similarly, an interior end 146 of the connecting shaft 136 may connect to an extension beam 148 that connects to a trailing end 145 of the support base 144. As shown, the connecting shafts 134, 136 and the extension beams 142, 144 may be angled to provide the roller assemblies 112 and 114 with an outwardly flared orientation that is configured to conform to a curvature of the component 200. The extension beams 142, 144 and the connecting shafts 134 and 136 may include pivotal connection interfaces that allow the rollers assemblies 112 and 114 to adapt to a changing curvature of the component 200.

Additional extension beams than shown may be used. For example, while the extension beams 142 and 148 are shown connecting proximate to the rollers 117 and 121, respectively, additional extension beams may be used to connect to connecting shafts 134 and 136 proximate to the rollers 119 and 123. Also, instead of extension beams that connect to the connecting shafts 134 and 136 proximate to the rollers 117 and 121, extension beams may, instead, connect to the connecting shaft 134 and 136 proximate to the rollers 119 and 123.

The support base 144 may include lateral brackets 160 and 162. A mounting cover 170 is secured between the lateral brackets 160 and 162. The mounting cover 170 provides an outer shroud around the sander 102. For example, a channel may be defined between the mounting cover 170 and an outer perimeter of the sander 102. In this manner, the mounting cover 170 provides a cowling that surrounds the sander 102, and which allows dust or debris from a sanding operation to be drawn into an integral vacuum 180, which may connect to a vacuum port 182 (such as a discharge removal port). In at least one embodiment, the vacuum port 182 may connect to a debris collection bag. In at least one other embodiment, the sanding system 100 may not include the vacuum 180. Instead, an external vacuum may connect to the vacuum port 182 through a hose, for example. In at least one other embodiment, the sanding system 100 may not include the vacuum 180 or the vacuum port 182.

The housing 108 may be mounted onto a top surface of the mounting cover 170. As noted, the control unit 106 and the memory 110 may be contained within the housing 108.

The tension roller assembly 124 may include one or more rollers 190 (three rollers 190 are shown in FIG. 2) that connect to the support base 144 through tension beams 192. The rollers 190 are configured to roll over the exterior surface 204 of the component 200. The tension beams 192 pull the support base 144, and therefore the sander 102, toward the rollers 190, and therefore bias (for example, pull) the sander 102 into the top surface 202 of the component 200.

Spring biased posts 194 may connect the mounting cover 170 to the support base 144, such as through angled lateral struts 196. The spring biased posts 194 may inwardly bias the support base 144, and therefore the sander 102, toward the interior surface 102 of the component 200.

The lateral brackets 160 and 162 may connect to the mounting cover 170 through panels 197. The height of the mounting cover 170, and therefore the sander 102, may be adjusted through adjustment members 198, such as threaded fasteners, that adjustably connect the mounting cover 170 to the lateral brackets 160 and 162. Alternatively, the sanding system 100 may not include the adjustment members 198. In at least one other embodiment, the control unit 106 may be operatively coupled to the adjustment members 198 to automatically control the height of the sander 102 in relation to the component 200. For example, based on analysis of signals received from the measuring devices, the control unit 106 may adjust the height of the sander 102 to sand a portion of the component 200 to a desired thickness.

Figure 3:
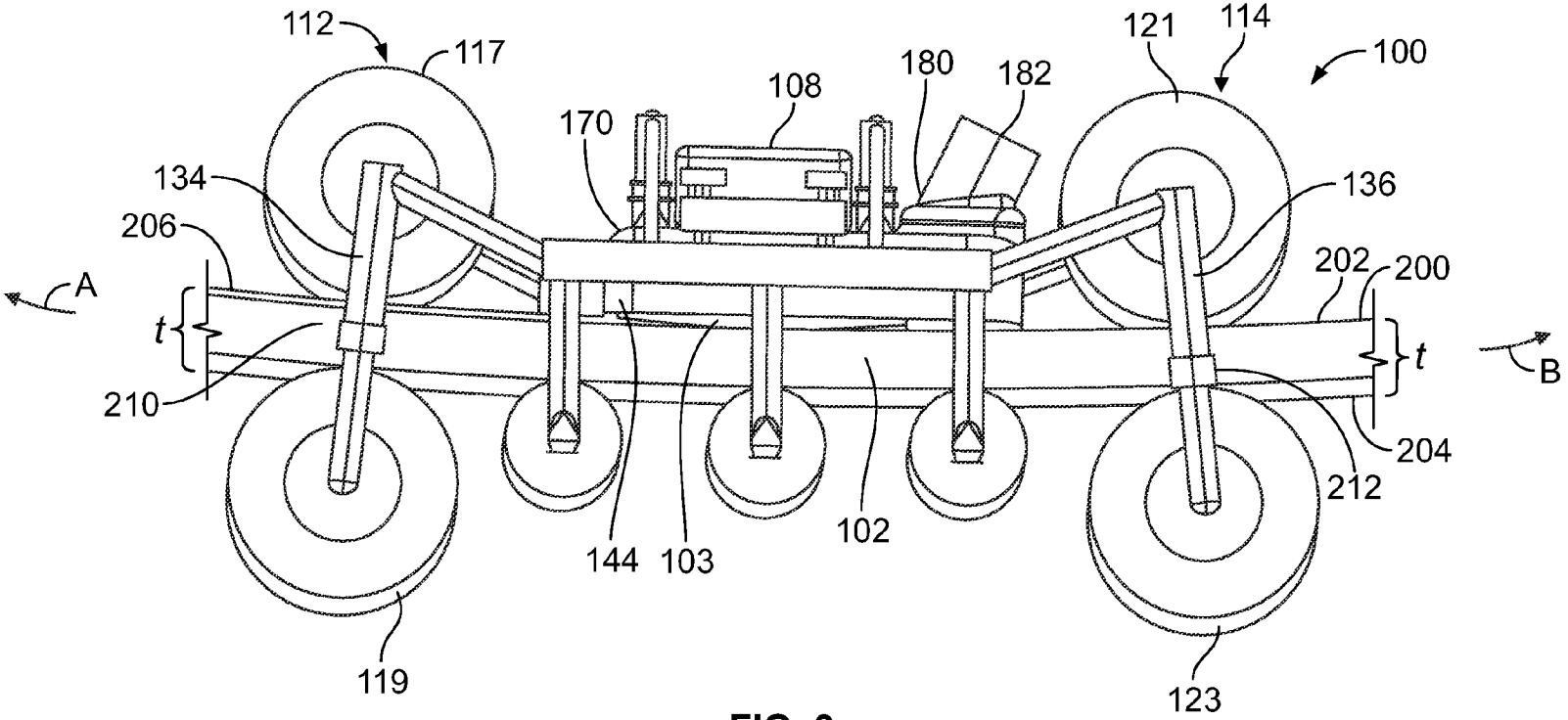
FIG. 3 illustrates a lateral perspective view of a sanding system positioned on a portion of a component, according to an embodiment of the present disclosure.

FIG. 3 illustrates a lateral perspective view of the sanding system 100 positioned on a portion of the component 102, according to an embodiment of the present disclosure. Referring to FIGS. 1 and 3, the sander 102 extends downwardly from the mounting cover 170 and is biased into the interior surface 202 of the component 200. The actuator 104 may be housed within the mounting cover 170. The sander 102 includes an abrasive surface 103 that is configured to abut into the surface 202. The abrasive surface 103 is actuated (for example, vibrational, orbital, or other such movement) to sand the surface 202.

In operation, the control unit 106, which may be contained within the housing 108, drives the sanding system 100 in the advancing direction A. The rollers 117 and 119 of the leading roller assembly 112 are biased toward one another and sandwich a location 210 of the component 200 proximate to or between the rollers 117 and 119 (i.e., the leading location). Similarly, the rollers 121 and 123 of the trailing roller assembly 114 are biased toward one another and sandwich a location 212 of the component 200 proximate to or between the rollers 121 and 123 (i.e., the trailing location). The control unit 106 monitors the distance between the rollers 117 and 119 of the leading roller assembly 112 and the distance between the rollers 121 and 123 of the trailing roller assembly 114 through the measuring devices 118 and 122, respectively. For example, the measuring devices 118 and 122 may be disposed within the connecting shafts 136, respectively.

The control unit 106 detects the thickness t of the component 200 at the leading location 210 through the measuring device 118. For example, the control unit 106 may correlate the distance between the rollers 117 and 119 with a thickness t. The control unit 106 compares the thickness t at the leading location 210 with a specified thickness for the component. The specified thickness may be stored in the memory. Based on the comparison between the thickness t and the specified thickness, the control unit 106 may control the actuator 104 to operate the sander 102 and/or increase or decrease tension between the support base 144 and the tension roller assembly 124 to sand the location 210 proximate the leading roller assembly 112 to the specified thickness.

Similarly, the control unit 106 detects the thickness t of the component 200 at the trailing location 212 through the measuring device 122 in order to determine whether the component 200 has been sanded to the specified thickness. Because the trailing location 212 trails the sander 102, the trailing location 212 has already been operated on (or not operated on) by the sander 102. The control unit 106 may correlate the distance between the rollers 121 and 123 with the thickness t. The control unit 106 compares the thickness t at the trailing location 212 with the specified thickness for the component 200. Based on the comparison between the thickness t and the specified thickness, the control unit 106 may determine if the trailing location 212 is to be sanded further so that the thickness t at the trailing location 212 equals or is within the specified thickness. If the thickness t at the trailing location 212 equals or is within the specified thickness (or within an acceptable range of the specified thickness), the control unit 106 continues to drive the sanding system 100 in the advancing direction A. If, however, the thickness t at the trailing location 212 is thicker than the specified thickness, the control unit 106 may move the sanding system 100 in the reversing direction B (or continue movement in the advancing direction A so that the sanding system 100 loops back to the same position) in order to further sand the area of the component 200.

During the sanding operation, debris (such as dust, component particles, and the like) may be vacuumed and removed through a vacuum that connects to the vacuum port 182. The vacuum may be external to the sanding system 100 and connected to the vacuum port 182 through a hose, for example. In at least one other embodiment, the sanding system 100 may include an integral vacuum. The integral vacuum may discharge debris through the vacuum port 182, which may connect to a debris collection bag, for example. Alternatively, the sanding system 100 may not include the vacuum 180 or the vacuum port 182.

Figure 4:
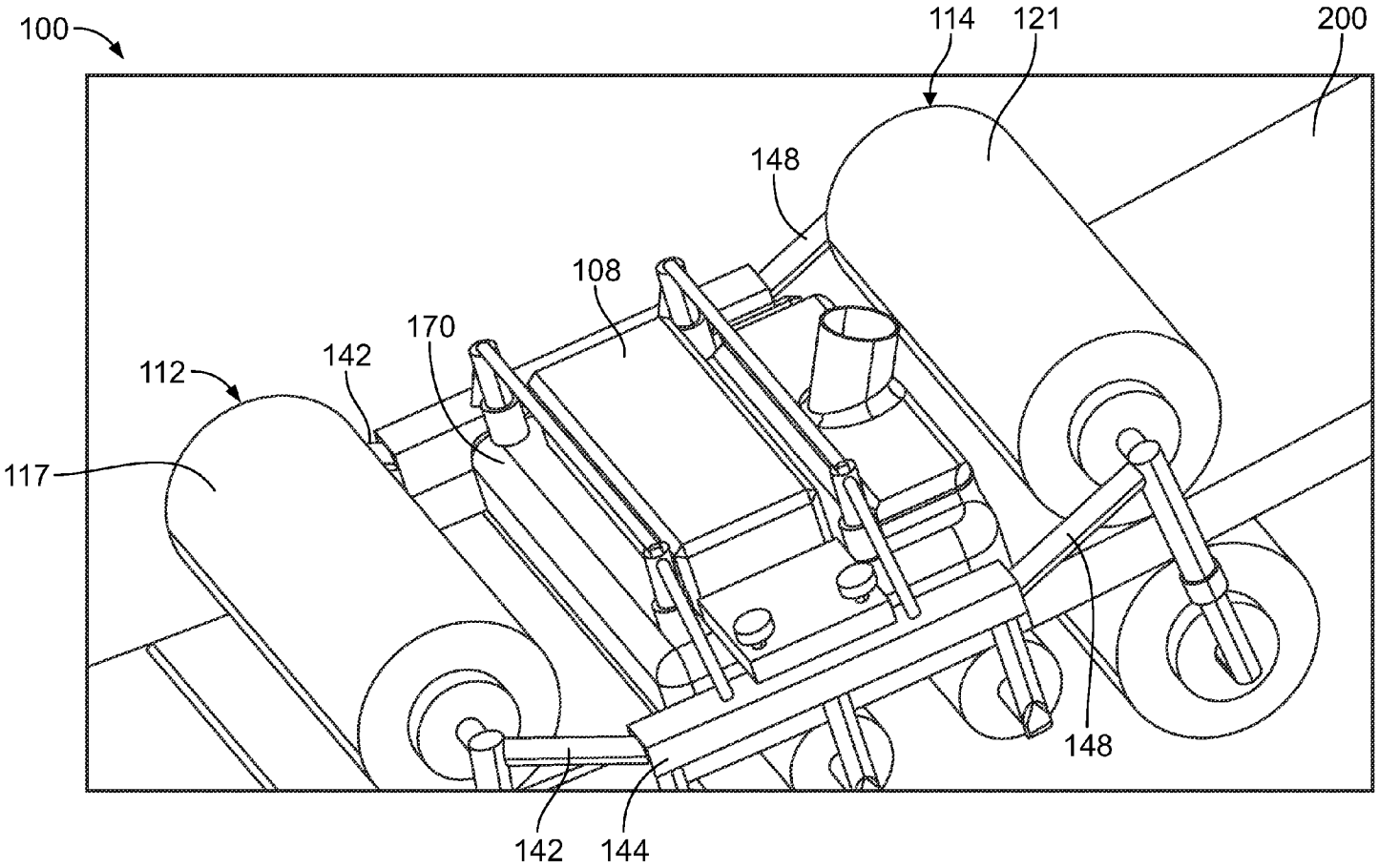
FIG. 4 illustrates a top perspective view of a sanding system positioned on a portion of a component, according to an embodiment of the present disclosure.

FIG. 4 illustrates a top perspective view of the sanding system 100 positioned on a portion of the component 200. As shown, extension beams 142 and 148 may connect the roller assemblies 112 and 114 to the support base 144 from both ends of the rollers 117 and 121, for example.

Figure 5:
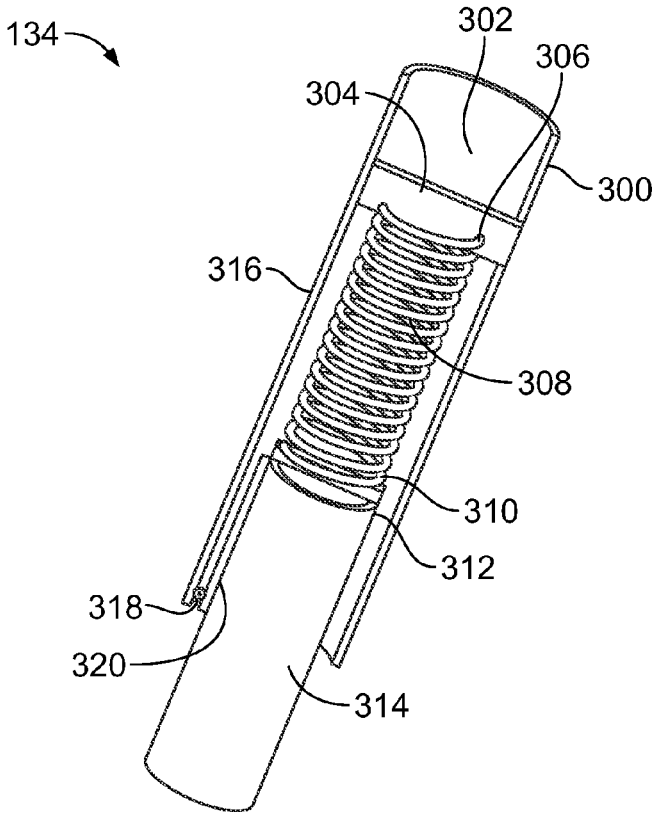
FIG. 5 illustrates an internal perspective view of a connecting shaft, according to an embodiment of the present disclosure.

FIG. 5 illustrates an internal perspective view of the connecting shaft 134, according to an embodiment of the present disclosure. While not shown in FIG. 5, it is to be understood that the connecting shaft 136 may be constructed in a similar fashion as the connecting shaft 134.

The connecting shaft 134 may include a cylindrical tube 300 defining an internal passage 302. An internal support 304 (such as a spar, rib, wall, or the like) may extend at an upper portion of the internal passage 302. A first end 306 of a biasing spring 308 may connect to the internal support 304, while a second end 310 of the biasing spring 308 may connect to an end 312 of a rod 314 that is configured to axially translate within a portion of the internal passage 302. The biasing spring 308 has a spring constant that biases the tube 300 and the rod 314 toward one another. The biasing spring 308 maintains an inwardly-biased tension on the rollers that ensures that the rollers abut against the component in a clamping and rolling fashion. In this manner, the rollers 117 and 119 are biased toward one another.

A wire 316 may extend over an outer surface of the tube 300 and connect the control unit 106 (shown in FIG. 1) to the measuring device 318 that may be moveably secured on a track 320 of the rod 314. The measuring device 318 may include one or more wheels that are configured to roll over the track 320 as the rod 314 moves in relation to the tube 300. The control unit 106 may monitor a position of the measuring device 318. For example, the control unit 106 may correlate a rotational position of the wheel to a relative position between the tube 300 and the rod 314. The control unit 106 may then correlate such position with a thickness of a component, for example.

Figure 6:
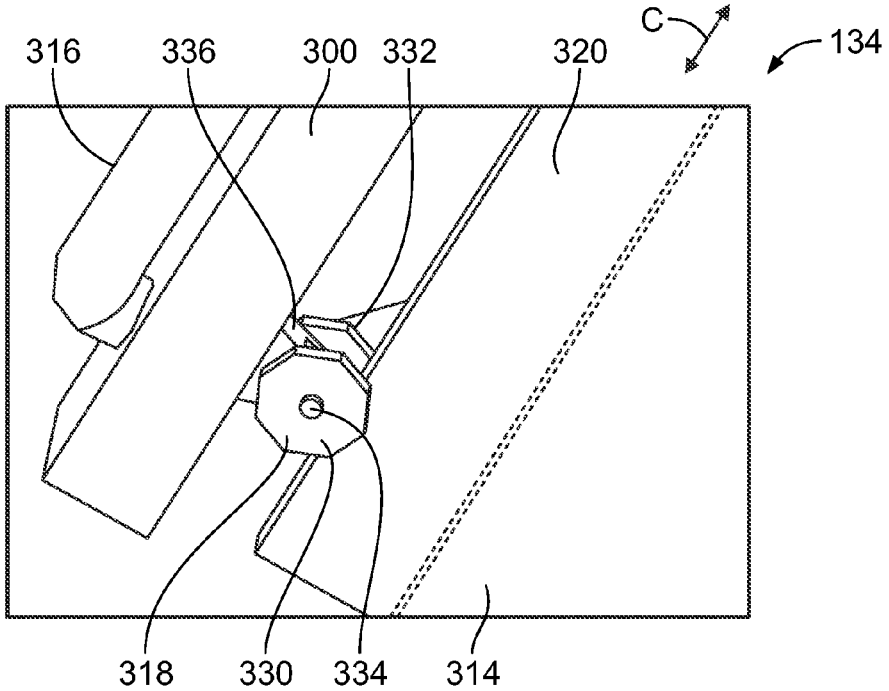
FIG. 6 illustrates an internal perspective view of a measuring device within a connecting shaft, according to an embodiment of the present disclosure.

FIG. 6 illustrates an internal perspective view of the measuring device 318 within the connecting shaft 134, according to an embodiment of the present disclosure. The measuring device 318 may include opposed wheels 330 and 332 connected to and separated by an axle 334 that is secured to a bracket 336 inwardly extending from the tube 300 into a space between the tube 300 and the rod 314. The wheels 330 and 332 may straddle the track 320. The wire 316 connects to the axle 334 and/or the wheels 330 and 332. In this manner, the control unit 106 (shown in FIG. 1) is able to determine a rotational position of the measuring device 318. For example, as the rod 314 slides in relation to the tube 300, the measuring device 318 rotates over the track 320, which moves along with the rod 314.

As shown, the measuring device 318 may be contained within the connecting shaft 134. Optionally, the measuring device 318 or an additional measuring device, may be secured to a portion of the rollers 117, 119 (such as the axle 132).

While the measuring device 318 is shown as a rotational wheel or wheels that are coupled to the control unit 106 through the wire 316, various other types of measuring devices may be used. For example, a positional sensor, such as one or more electromagnetic tags, RFID tags, or the like may be secured to one or more portions of the connecting shaft 134, and/or the rollers 117 or 119. The measuring device 318 may be any type of device that may be secured to a portion of the sanding system 100 (shown in FIG. 1) and detected to determine a thickness of a component.

In at least one embodiment, the measuring device 318 may be or include laser sensors. A laser sensor may be configured to be positioned on either side of the component in relation to each of the leading and trailing locations. The laser sensors may be in communication with the control unit 106 and used to determine the thickness of the component at the leading and trailing locations.

Referring to FIGS. 1-6, the sanding system 100 may be clamped onto an edge of the component, such as the outer edge of a barrel section. The sanding system 100 may be used to sand an inner mold line of a barrel section, for example.

Figure 7:
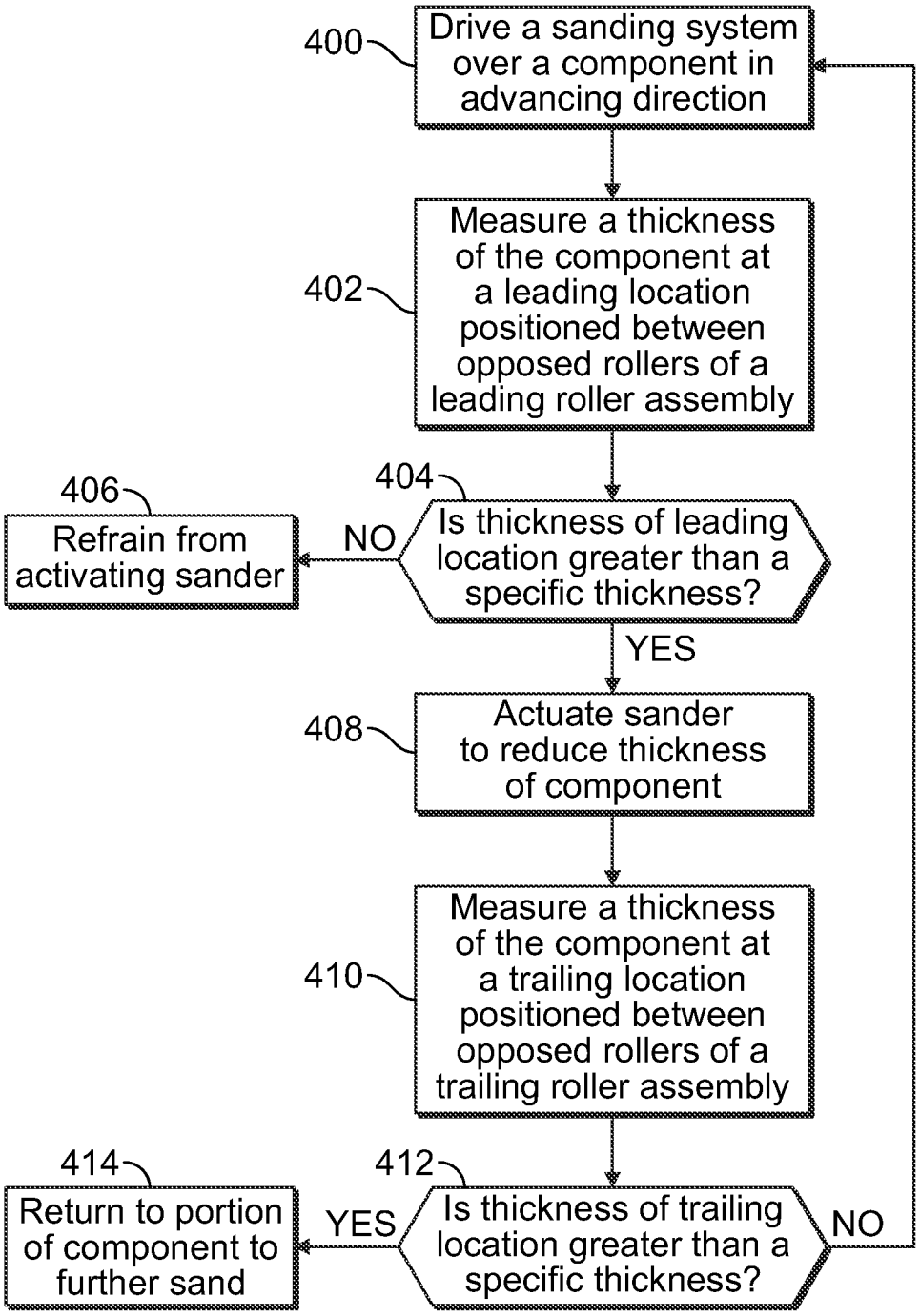
FIG. 7 illustrates a flow chart of a method of automatically sanding a component, according to an embodiment of the present disclosure.

FIG. 7 illustrates a flow chart of a method of automatically sanding a component, according to an embodiment of the present disclosure. The control unit 106 (shown in FIG. 1) is configured to perform the operations shown in the flow chart of FIG. 7. For example, the control unit 102 may include at least one processor, and the memory 110 coupled to the processor(s). The memory 110 stores program instructions that are executable by the processor(s) to perform the operations shown and described in the flow chart.

The method begins at 400, in which a sanding system is driven over a component in an advancing direction. At 402, a thickness of the component at a leading location (such as a location proximate the leading roller assembly) is measured. The leading location proximate the leading roller assembly may be the portion of the component positioned between opposed rollers of a leading roller assembly. At 404, it is determined whether the measured thickness at the leading location is greater than a specified thickness, which may be stored in memory. If the thickness at the leading location is not greater than the specified thickness, at 406 the sander is not activated (that is, the sander remains deactivated). If, however, the thickness of the component at the leading location is greater than the specified thickness, the sander is activated at 408 to reduce the thickness of the component at the leading location. Notably, because the sanding system is being driven in the advancing direction, the portion of the component at the leading location at an initial time encounters the sander with continued advancement of the sanding system. Similarly, after the portion is sanded, it will become a trailing location (such as a location proximate the trailing roller assembly or between rollers of a trailing roller assembly) with continued advancement of the sanding system.

At 410, a thickness of the component at the trailing location (such as a location proximate the trailing roller assembly or positioned between opposed rollers of the trailing assembly) is measured. It is to be understood that the steps 402 and 410 may occur at the same time and/or continuously during operation of the sanding system. At 412, it is determined if the thickness at the trailing location is greater than the specified thickness. If not, the method returns to 400. If so, the method proceeds from 412 to 414, in which the sanding system returns to the portion of the component to further sand. For example, the sanding system may be reversed, or simply advanced a full rotation back to the location.

As described above, embodiments of the present disclosure provide systems and methods for accurately and efficiently sanding components, such as ends of composite barrel sections of a fuselage of an aircraft. The systems and methods reduce the amount of labor and time to form various components, such as barrel sections that are used to form a fuselage of an aircraft. In particular, the systems and methods substantially reduce the labor and time to sand portions of a component, as the systems and methods may be fully automated.

Figure 8:
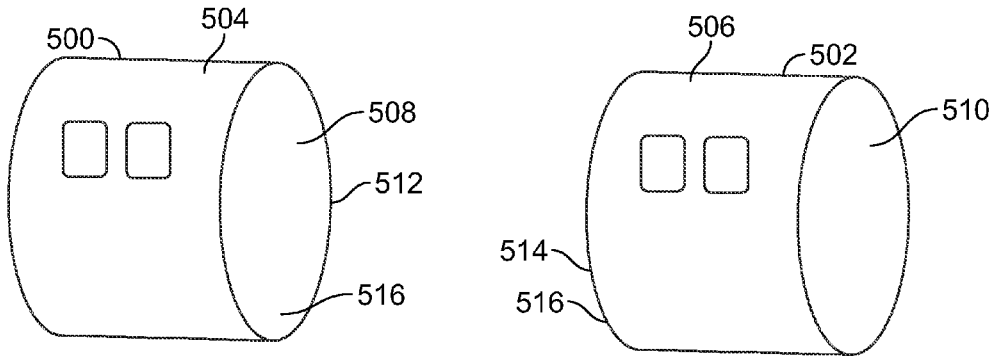
FIG. 8 illustrates a perspective lateral view of barrel sections, according to an embodiment of the present disclosure.

FIG. 8 illustrates a perspective lateral view of barrel sections 500 and 502, according to an embodiment of the present disclosure. The barrel sections 500 and 502 represent components that have portions that may be sanded by the systems and methods described in the present application.

Each barrel section 500 and 502 includes a respective circumferential wall 504 and 506 that defines a respective internal chamber 508 and 510. End edges 512 and 514 may be sanded through the systems and methods described in the present application. For example, sanding systems described in the present application may be clamped to the end edges 512, and sand interior mold lines 516 thereof.

After the end edges 512 are sanded to a specified thickness, the barrel section 500 may be joined to the barrel section 502. Additional barrel sections may be added to form a fuselage of an aircraft.

The barrel sections 500 and 502 are merely examples of components having portions that may be sanded as described in the present application. It is to be understood that embodiments of the present application may be used with various other components. Indeed, embodiments of the present disclosure may be used with respect to most, if not all, components that are to be sanded.

Figure 9:
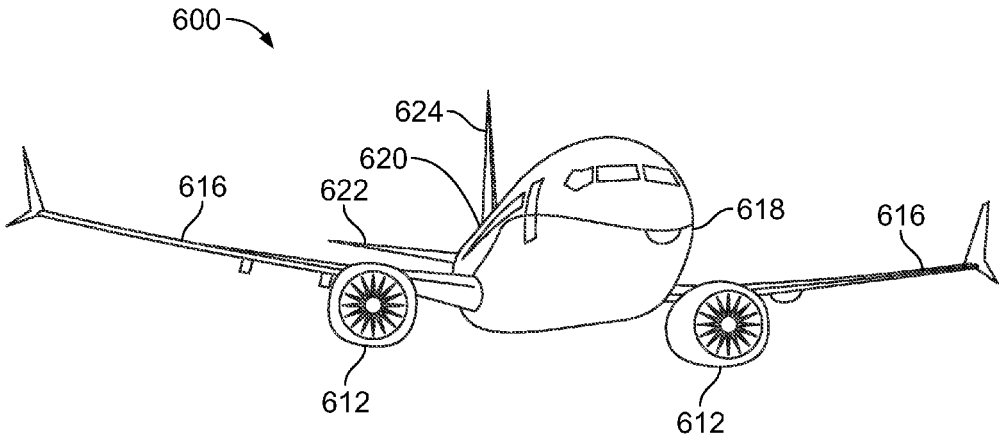
FIG. 9 illustrates a perspective front view of an aircraft, according to an embodiment of the present disclosure.

FIG. 9 illustrates a perspective front view of an aircraft 600, according to an embodiment of the present disclosure. The aircraft 600 may include a propulsion system that may include two turbofan engines 612, for example. Optionally, the propulsion system may include more engines 612 than shown. The engines 612 are carried by wings 616 of the aircraft 600. In other embodiments, the engines 612 may be carried by a fuselage 618 and/or an empennage 620. The empennage 620 may also support horizontal stabilizers 622 and a vertical stabilizer 624. The wings 616, the horizontal stabilizers 622, and the vertical stabilizer 624 may each include one or more control surfaces. The fuselage 618 may be formed through barrel sections, such as those shown and described with respect to FIG. 8.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal language of the claims.

What is claimed is:

1. A sanding system configured to sand a portion of a component, the sanding system comprising:

a leading roller assembly including a first measuring device, wherein the first measuring device is configured to measure a first thickness of the component at a location proximate the leading roller assembly;

a trailing roller assembly including a second measuring device, wherein the second measuring device is configured to measure a second thickness of the component at a location proximate the trailing roller assembly;

a sander disposed between the leading roller assembly and the trailing roller assembly configured to sand the portion of the component; and a control unit coupled to the leading roller assembly, the trailing roller assembly, and the sander, wherein the control unit comprises at least one processor, and a memory coupled to the at least one processor, wherein the memory stores program instructions, wherein the program instructions are executable by the at least one processor to drive the sanding system in relation to the component and operate the sander based on analysis of the first thickness measured by the first measuring device and the second thickness measured by the second measuring device.

2. The sanding system of claim 1, further comprising at least one motor operatively coupled to the control unit and one or both of the leading roller assembly and the trailing roller assembly, wherein the at least one motor is configured to drive the sanding system over the portion of the component.

3. The sanding system of claim 1, further comprising a tension roller assembly having at least one roller that is configured to engage a surface of the component, wherein the tension roller assembly is configured to bias the sander into the component.

4. The sanding system of claim 1, further comprising an actuator operatively connected to the sander, wherein the control unit is coupled to the sander through the actuator.

5. The sanding system of claim 1, wherein the leading roller assembly comprises a first roller and a second roller, wherein the location of the component proximate the leading roller assembly is the portion of the component positioned between the first and second rollers, wherein the trailing roller assembly comprises a third roller and a fourth roller, and wherein the location of the component proximate the trailing roller assembly is the portion of the component positioned between the third and fourth rollers.

6. The sanding system of claim 5, wherein the first roller connects to the second roller through a first connecting shaft, and wherein the third roller connects to the fourth roller through a second connecting shaft.

7. The sanding system of claim 6, wherein the first measuring device is secured to one or more of the first roller, the second roller, or the first connecting shaft, and wherein the second measuring device is secured to one or more of the third roller, the fourth roller, or the second connecting shaft.

8. The sanding system of claim 6, wherein the first connecting shaft comprises a first biasing spring that biases the first and second rollers toward one another, and wherein the second connecting shaft comprises a second biasing spring that biases the third and fourth rollers toward one another.

9. The sanding system of claim 1, further comprising:

a mounting cover that surrounds a perimeter of the sander; and a housing mounted on the mounting cover, wherein the housing contains the control unit.

10. The sanding system of claim 9, wherein the mounting cover comprises a vacuum port that is configured to connect to a vacuum that is configured to remove debris generated by operation of the sander through the vacuum port.

11. The sanding system of claim 1, wherein the control unit is remotely located from and in communication with leading roller assembly, the trailing roller assembly, the motor, and the sander.

12. The sanding system of claim 1, wherein the program instructions are executable by the at least one processor to: monitor the first thickness to determine an amount of material to be sanded from the component, and monitor the second thickness to determine if a sanded portion of the component is at or within a specified thickness.

13. The sanding system of claim 1, wherein at least one of the first and second measuring devices comprises a rotational position sensor comprising at least one wheel, wherein the program instructions are executable by the at least one processor to monitor rotational positions of the at least one wheel.

14. The sanding system of claim 1, further comprising a support base connected to the sander, wherein a height of the support base in relation to the component is adjustable.

15. A method of sanding a portion of a component, the method comprising:

driving a sanding system over the portion of the component;

using a first measuring device of a leading roller assembly of the sanding system to measure a first thickness of the component at a location proximate the leading roller assembly;

using a second measuring device of a trailing roller assembly of the sanding system to measure a second thickness of the component at a location proximate the trailing roller assembly;

analyzing the first thickness measured by the first measuring device and the second thickness measured by the second measuring device; and operating a sander based the analyzing.

16. The method of claim 15, further comprising removing debris caused by the operating through a vacuum port.

17. The method of claim 15, wherein analyzing comprises:

monitoring the first thickness to determine an amount of material to be sanded from the component, and monitoring the second thickness to determine if a sanded portion of the component is at or within a specified thickness.

18. The method of claim 17, further comprising adjusting a position of the sander in relation to the component based on the analyzing.

19. A sanding system configured to sand a portion of a component, the sanding system comprising:

a leading roller assembly including a first measuring device, wherein the first measuring device is configured to measure a first thickness of the component at a location proximate the leading roller assembly;

a trailing roller assembly including a second measuring device, wherein the second measuring device is configured to measure a second thickness of the component at a location proximate the trailing roller assembly;

at least one motor coupled to one or both of the leading roller assembly and the trailing roller assembly, wherein the at least one motor is configured to drive the sanding system over the portion of the component;

a sander disposed between the leading roller assembly and the trailing roller assembly configured to sand the portion of the component;

a mounting cover that surrounds a perimeter of the sander, wherein the mounting cover includes a vacuum port that is configured to connect to a vacuum that is configured to remove debris generated by operation of the sander through the vacuum port;

an adjustable support base connected to the mounting cover, wherein a height of the actuator in relation to the component is adjustable;

a tension roller assembly that is configured to bias the sander into the component; and a control unit coupled to the leading roller assembly, the trailing roller assembly, the at least one motor, and the sander, wherein the control unit comprises at least one processor, and a memory coupled to the at least one processor, wherein the memory stores program instructions, wherein the program instructions are executable by the at least one processor to: operate the at least one motor and the sander based on analysis of the first thickness measured by the first measuring device and the second thickness measured by the second measuring device, monitor the first thickness to determine an amount of material to be sanded from the component, and monitor the second thickness to determine if a sanded portion of the component is at or within a specified thickness.

20. The sanding system of claim 19, wherein the leading roller assembly includes a first roller and a second roller, wherein the location of the component proximate the leading roller assembly is the portion of the component positioned between the first and second rollers, wherein the trailing roller assembly includes a third roller and a fourth roller, wherein the location of the component proximate the trailing roller assembly is the portion of the component positioned between the third and fourth rollers, wherein the first roller connects to the second roller through a first connecting shaft, and wherein the third roller connects to the fourth roller through a second connecting shaft.

* * * * *